US012188216B2

(12) United States Patent
Ball et al.

(10) Patent No.: US 12,188,216 B2
(45) **Date of Patent: *Jan. 7, 2025**

(54) WASTEWATER DRAIN STOPPER SYSTEM

(71) Applicant: WCM Industries, Inc., Colorado Springs, CO (US)

(72) Inventors: William Ball, Colorado Springs, CO (US); Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/466,317

(22) Filed: Sep. 13, 2023

(65) Prior Publication Data

US 2024/0003127 A1 Jan. 4, 2024

Related U.S. Application Data

(60) Continuation of application No. 17/649,480, filed on Jan. 31, 2022, now Pat. No. 11,781,303, which is a continuation of application No. 17/104,785, filed on Nov. 25, 2020, now Pat. No. 11,280,074, which is a continuation of application No. 16/280,158, filed on Feb. 20, 2019, now Pat. No. 10,870,975, which is a division of application No. 15/171,642, filed on Jun. 2, 2016, now Pat. No. 10,233,622.

(60) Provisional application No. 62/171,656, filed on Jun. 5, 2015.

(51) Int. Cl.
*E03C 1/262* (2006.01)
*E03C 1/23* (2006.01)

(52) U.S. Cl.
CPC ..... *E03C 1/262* (2013.01); *E03C 1/2302* (2013.01)

(58) Field of Classification Search
CPC ..... E03C 1/262; E03C 1/2302
USPC ..... 4/287, 286, 288, 289, 290
See application file for complete search history.

(56) References Cited

U.S. PATENT DOCUMENTS

| | | | |
|---|---|---|---|
| 1,647,188 | A | 11/1927 | Mueller et al. |
| 1,980,250 | A | 11/1934 | Baxter |
| 2,179,121 | A | 11/1939 | Frank et al. |
| 2,486,246 | A | 10/1949 | Beeke |
| 2,807,806 | A | 10/1957 | Watkins |
| 2,827,639 | A | 3/1958 | Schmidt |
| 3,002,196 | A | 10/1961 | Mackey, Jr. |
| 3,010,118 | A | 11/1961 | Isherwood |
| 3,314,083 | A | 4/1967 | Minella |
| 3,314,085 | A | 4/1967 | Minella |
| 4,192,026 | A | 3/1980 | Williams |
| 4,577,349 | A | 3/1986 | Clegg |
| 4,596,057 | A | 6/1986 | Ohta et al. |
| 4,807,306 | A | 2/1989 | Hayman et al. |
| 5,050,247 | A | 9/1991 | Hsu |
| 5,208,921 | A | 5/1993 | Nicoll |

(Continued)

OTHER PUBLICATIONS

U.S. Pat. No. 773,408, issued Oct. 25, 1904 in the name of Moore, entitled "Washbasin-fixture and basin".

*Primary Examiner* — Lori L Baker

(57) ABSTRACT

A wastewater drain assembly that includes a selectively openable drain stopper. The wastewater drain assembly is interconnected to a fluid basin wherein a flange, which is interconnected to wastewater plumbing, is situated within the sink. The flange receives an insert that has a portion that conceals the flange.

20 Claims, 10 Drawing Sheets

(56) References Cited

U.S. PATENT DOCUMENTS 5,363,519 A 11/1994 Husting
5,640,724 A 6/1997 Holmes
5,745,931 A * 5/1998 Ball ..... E03C 1/20 4/286
5,749,561 A 5/1998 Worthington
5,758,368 A * 6/1998 Ball ..... A47K 1/14 4/293
5,787,521 A 8/1998 O'Connell et al.
5,822,812 A 10/1998 Worthington et al.
6,066,119 A * 5/2000 Ball ..... A47K 1/14 4/286
6,138,297 A 10/2000 Harris et al.
6,154,898 A * 12/2000 Ball ..... E03C 1/232 4/689
6,219,861 B1 4/2001 Chen
6,226,806 B1 * 5/2001 Ball ..... E03C 1/22 4/286
6,282,730 B1 9/2001 Duncan
6,308,351 B1 10/2001 Franke
6,367,102 B1 4/2002 McMullen
6,470,514 B2 10/2002 Onoue
6,484,330 B2 11/2002 Gray et al.
6,973,685 B2 12/2005 Duncan
7,503,083 B2 * 3/2009 Ball ..... E03C 1/22 285/46
7,856,680 B2 * 12/2010 Scheel ..... E03C 1/264 4/DIG. 14
8,607,376 B2 * 12/2013 Ball ..... E03C 1/22 285/46
9,015,870 B2 * 4/2015 Ball ..... E03C 1/22 4/286
9,015,876 B2 * 4/2015 Ball ..... E03C 1/22 285/46
10,233,622 B2 * 3/2019 Ball ..... E03C 1/2302
10,563,385 B1 * 2/2020 Ball ..... E03C 1/232
10,870,975 B2 * 12/2020 Ball ..... E03C 1/262
11,162,250 B2 * 11/2021 Shinde ..... E03C 1/2302
11,280,074 B2 * 3/2022 Ball ..... E03C 1/2302
11,781,303 B2 * 10/2023 Ball ..... E03C 1/2302 4/287
2003/0041374 A1 3/2003 Franke
2006/0179564 A1 8/2006 Jacobs
2009/0151060 A1 6/2009 Zubillaga et al.
2009/0172877 A1 7/2009 Ball
2009/0255041 A1 10/2009 Duncan
2010/0037392 A1 * 2/2010 Ball ..... E03C 1/232 4/683
2010/0154114 A1 6/2010 Van Zeeland et al.
2016/0356028 A1 12/2016 Ball
2019/0177958 A1 6/2019 Ball

* cited by examiner

WASTEWATER DRAIN STOPPER SYSTEM

CROSS-REFERENCE TO RELATED APPLICATIONS

This application is a continuation of U.S. patent application Ser. No. 17/649,480 filed Jan. 31, 2022, which is a continuation of U.S. patent application Ser. No. 17/104,785, filed Nov. 25, 2020, now U.S. Pat. No. 11,280,074 which is a continuation of U.S. Patent application Ser. No. 16/280,158, filed Feb. 20, 2019, now U.S. Pat. No. 10,870,975, which is a divisional of U.S. patent application Ser. No. 15/171,642, filed Jun. 2, 2016, now U.S. Pat. No. 10,233,622, which claims the benefit of U.S. Provisional Patent Application Ser. No. 62/171,656, filed Jun. 5, 2015, the entireties of which is are incorporated by reference herein. To the extent appropriate a claim for priority is made to each of the preceding applications.

FIELD OF THE INVENTION

Embodiments of the present invention are generally related to sink drain closures. More specifically, some embodiments of the present invention are directed to selectively closable stoppers used in sinks or other fluid basins.

BACKGROUND OF THE INVENTION

Sink drain closures are sometimes comprised of a selectively movable drain stopper that has a first portion used to seal the drain and a second portion operatively interconnected to a mechanism that facilitates movement of the drain stopper. An example of a common sink drain closure is shown in FIG. 1. FIG. 1 shows a sink 2 with interconnected to a wastewater drain system 6 of a dwelling. The wastewater drain system 6 is interconnected to a body 10 that is held to the sink 2 with a flange 14. The body 10 includes a threaded portion 18 that selectively receives the flange 14, wherein the body 10 is secured to the sink 2 with the seal 22 and nut 26 engaged to the threaded portion 18, and abutted against an outer surface of the sink 2. In other versions, the flange 14 is integrated to the body 10.

As shown in FIG. 1, a drain stopper 30 is placed within the body 10. Operation of the drain stopper 30 to control fluid flow from the sink is achieved by providing a ball rod 34 that is inserted into the body 10. A first end 38 of the ball rod 34 interfaces with the second portion 40 of the drain stopper 30 such that when the ball rod 34 is rotated about a ball 42 seated in the body 10, the drain stopper 30 will move. As those of ordinary skill in the art will appreciate, movement of the ball rod 34 is achieved by movement of a link 46 interconnected to a second end 50 of the ball rod with a clip 54.

Common sink drain closures are expensive to manufacture and/or to install, and tend to experience decreased functionality after long-term use. They are also not easily cleaned or accessible for repair and replacement.

Thus it is a long felt need to provide a sink drain closure that is easy to install and replace. The following disclosure describes an improved sink drain stopper adapted for interconnection to a sink and which includes an insert that allows for selective alteration of the aesthetic appearance of the sink.

SUMMARY OF THE INVENTION

It is one aspect of embodiments of the present invention to provide a sink drain closure that is inexpensive to manufacture and highly efficient to use and operate. It is another aspect to provide a sink drain closure that provides enhanced access to valve closure elements. That is, embodiments of the present invention include easily-removable parts that allow access to a fluid control valve positioned within the wastewater plumbing found below the sink.

More specifically, the fluid control valve comprises a drain stopper with a diameter greater than that of an opening in a valve seat integrated into the body. The drain stopper is, thus, adapted to close the opening to fluid flow. The valve element is interconnected to a valve stem that extends downwardly through the opening in the valve seat. A lower end of the valve stem is connected to a ball rod used to selectively move the drain stopper and open/close the fluid control valve.

Some embodiments also provide a strainer element that extends across a port in the bottom of the sink to prevent large particulate matter to enter the wastewater plumbing. The strainer of one embodiment is incorporated into an insert selectively interconnected to a flange that connects the sink to the wastewater plumbing. Strainers of some embodiments of the present invention include a plurality of holes. The holes are large enough to allow water therethrough, but are designed to prevent hair, Q-tips, wedding rings, etc. from entering into the wastewater plumbing.

It is another aspect of some embodiments of the present invention to provide a drain stopper that is concealed within the wastewater drain plumbing. For example, some embodiments employ a valve seat associated with the internal surface of the wastewater drain pipe. The valve seat selectively receives a drain stopper that is moved in the same or similar fashion as prior art systems. Here, however, the drain stopper and associated seal interact with the seat and is completely concealed from the user. Accordingly, this aspect of the present invention eliminates the unaesthetic qualities of prior art drain stoppers, e.g., they do not sit flush with the bottom surface of the sink when opened. Stated differently, the prior art drain stoppers when an open configuration, provide an unsightly, loose-fitting appearance.

It is yet another aspect of some embodiments the present invention to provide a sink drain closure system that is easy to replace or repair. Those of ordinary skill in the art will appreciate that if the prior art drain stoppers become damaged, or if the homeowner wishes to change the aesthetic appearance of the sink fixtures, the drain stopper and associated strainer must be replaced. For example, changing the sink flange (i.e., the flange associated with a strainer) from chrome to a brushed-nickel finish would be a time-consuming and expensive task. Conversely, embodiments of the present invention are easily repaired by simply replacing an insert selectively interconnected to the sink flange. Again, only the insert would need to be replaced as the drain stopper and associated components are completely concealed. Indeed, the shape, color, form, etc. of the drain stopper is irrelevant in some instances as it is never visible during use. Thus some embodiments of the present invention avoid the expense associated with manufacturing an aesthetically pleasing drain stopper, e.g., one made of chrome.

It is still yet another aspect of embodiments of the present invention to provide a drain stopper that provides a tight seal. More specifically, the drain stoppers of the prior art employ a seal that interfaces with an inner surface of the strainer. Thus, the drain stopper seal must be dimensioned such that it easily fits within the sink strainer, which often renders the drain stopper seal ineffective. Conversely, embodiments of the present invention employ a seal that tightly engages a seat position in the drain plumbing, thereby providing an enhanced seal that prevents water from exiting the sink.

Thus it is one aspect of the present invention to provide a wastewater drain system, comprising: a body having a first, threaded end and a second end adapted for interconnection to wastewater drain pipes of a structure, the body having an opening for receipt of a ball rod; a flange interconnected to the first end of the body; a seal positioned about the body; a nut positioned about the body, the nut and the seal adapted to be abutted against an exterior of a fluid receptacle, wherein the flange is abutted against an interior of the fluid receptacle, and wherein the body is secured to the fluid receptacle by the flange and the nut; a stem having a proximal end and a distal end, the distal end operatively interconnected to an end of the ball rod, wherein the proximal end includes a stopper; an insert selectively interconnected to the flange; and wherein the stem can be moved with the ball rod from a first position of use to engage the stopper against a seat positioned in the body to prevent fluid flow through the wastewater drain system, and a second position of use that separates the stopper from the seat to allow fluid flow through the wastewater drain system.

Thus it is another aspect of the present invention to provide a wastewater drain system interconnected to a sink drain port, comprising: a body having a first, threaded end and a second end adapted for interconnection to wastewater drain pipes of a structure, the body having an opening for receipt of a ball rod; a stem having a proximal end and a distal end, the distal end operatively interconnected to an end of the ball rod, wherein the proximal end includes a stopper; and an insert associated with the drain port and selectively interconnected to the body.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
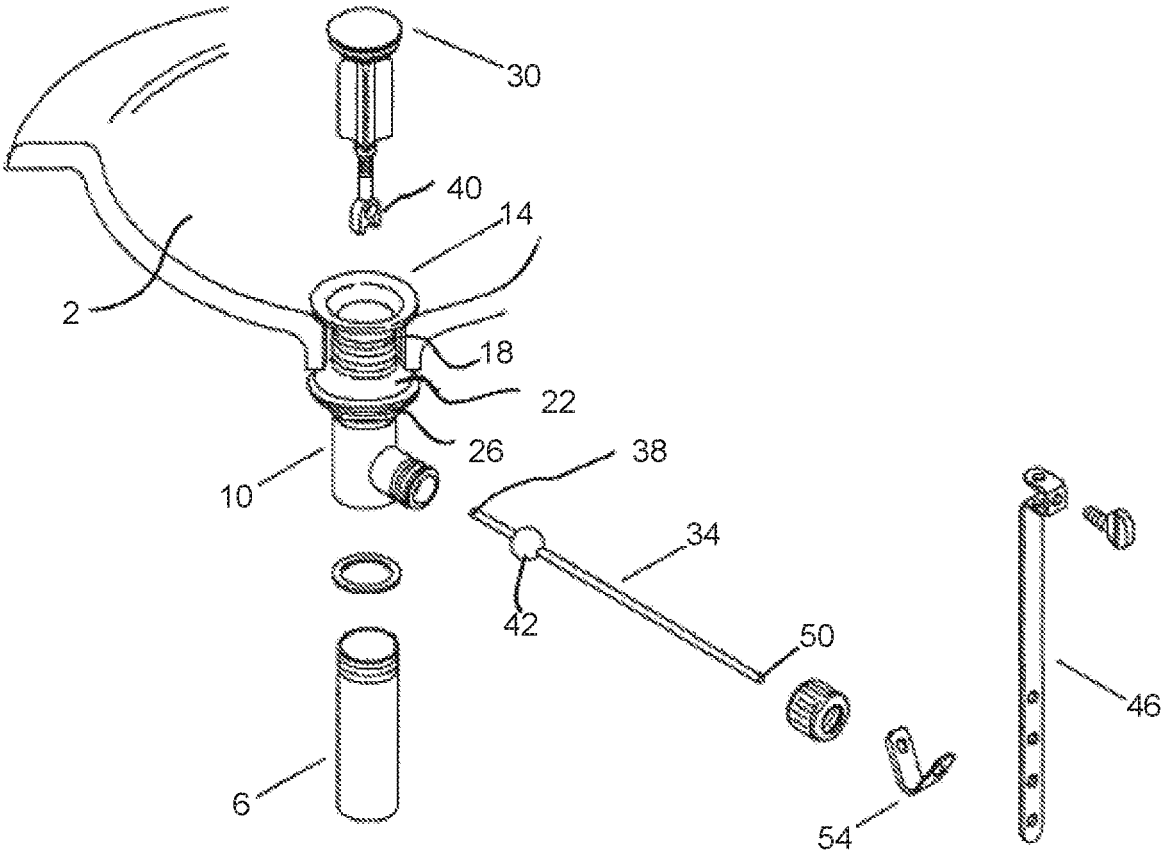
FIG. 1 (Prior Art)
FIG. 1 is a partial perspective view of a common wastewater drain system.

To assist in the understanding of one embodiment of the present invention the following list of components and associated numbering found in the drawings is provided herein:

| # | Component |
|---|---|
| 2 | Sink |
| 6 | Wastewater drain system |
| 10 | Body |
| 14 | Sink flange |
| 18 | Threaded portion |
| 22 | Seal |
| 26 | Nut |
| 30 | Drain stopper |
| 34 | Ball rod |
| 38 | First end |
| 40 | Second portion |
| 42 | Ball |
| 46 | Link |
| 50 | Second end |
| 54 | Clip |
| 110 | Body |
| 114 | Sink flange |
| 118 | Threaded portion |
| 122 | Seal |
| 126 | Nut |
| 130 | Drain stopper |
| 132 | Nut |
| 134 | Ball rod |
| 140 | Distal end |
| 142 | Ball |
| 146 | Link |
| 154 | Clip |
| 158 | Rod |
| 162 | Thumbscrew |
| 166 | Knob |
| 170 | Valve stem |
| 174 | Seat |
| 180 | Insert |
| 184 | Upper seal |
| 188 | Holes |
| 192 | Seal |
| 194 | Insert wall |
| 196 | Inner surface |
| 197 | Lower surface |
| 198 | Shoulder |
| 200 | Lower surface |
| 204 | Shoulder |
| 206 | Flange wall |
| 207 | Groove |
| 208 | Boss |
| 209 | Recess |
| 210 | Body |
| 214 | Sink flange |
| 222 | Seal |

-continued

| # | Component |
|---|---|
| 226 | Nut |
| 230 | Drain stopper |
| 270 | Valve stem |
| 274 | Seat |
| 280 | Insert |
| 310 | Body |
| 314 | Sink flange |
| 326 | Nut |
| 330 | Drain stopper |
| 332 | Seal |
| 334 | Ball rod |
| 340 | Distal end |
| 342 | Threaded portion |
| 343 | Opening |
| 370 | Valve stem |
| 380 | Insert |
| 382 | Hub |
| 386 | Drain stopper seal |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 2-5 show a drain closure system of one embodiment of the present invention. The drain closure system is comprised of a body 110 having a threaded portion 118 that terminates at a sink flange 114. As those of ordinary skill in the art will appreciate, the body of this and other embodiments of the present invention described herein may be made of multiple pieces. The body 110 also receives a nut 132 that secures a ball rod 134, wherein a portion of the ball rod 134 is positioned within the body 110. The body 110 is interconnected to the sink, wherein the flange 114 is in contact with a lower surface of sink. Next, a nut 126 and associated seal 122 are interface with a threaded portion 118 of the body 110 and tighten against a lower outer surface of the sink to secure the body 110 to the sink. After the body 110 is secured to the sink, it is also interconnected to the wastewater drain plumbing of the dwelling. The ball rod 134 is interconnected to a link 146 via a clip 154, or other device. The link 146 is secured to a rod 158 with a thumbscrew 162, or other device. The rod terminates at a knob 166, wherein movement of the rod 166 will selectively move the ball rod 134 and, thus, a portion of the ball rod 134 positioned within the body 110. The interconnection between the ball rod 134 and the body 110 should be well known by those of ordinary skill in the art.

Figure 3:
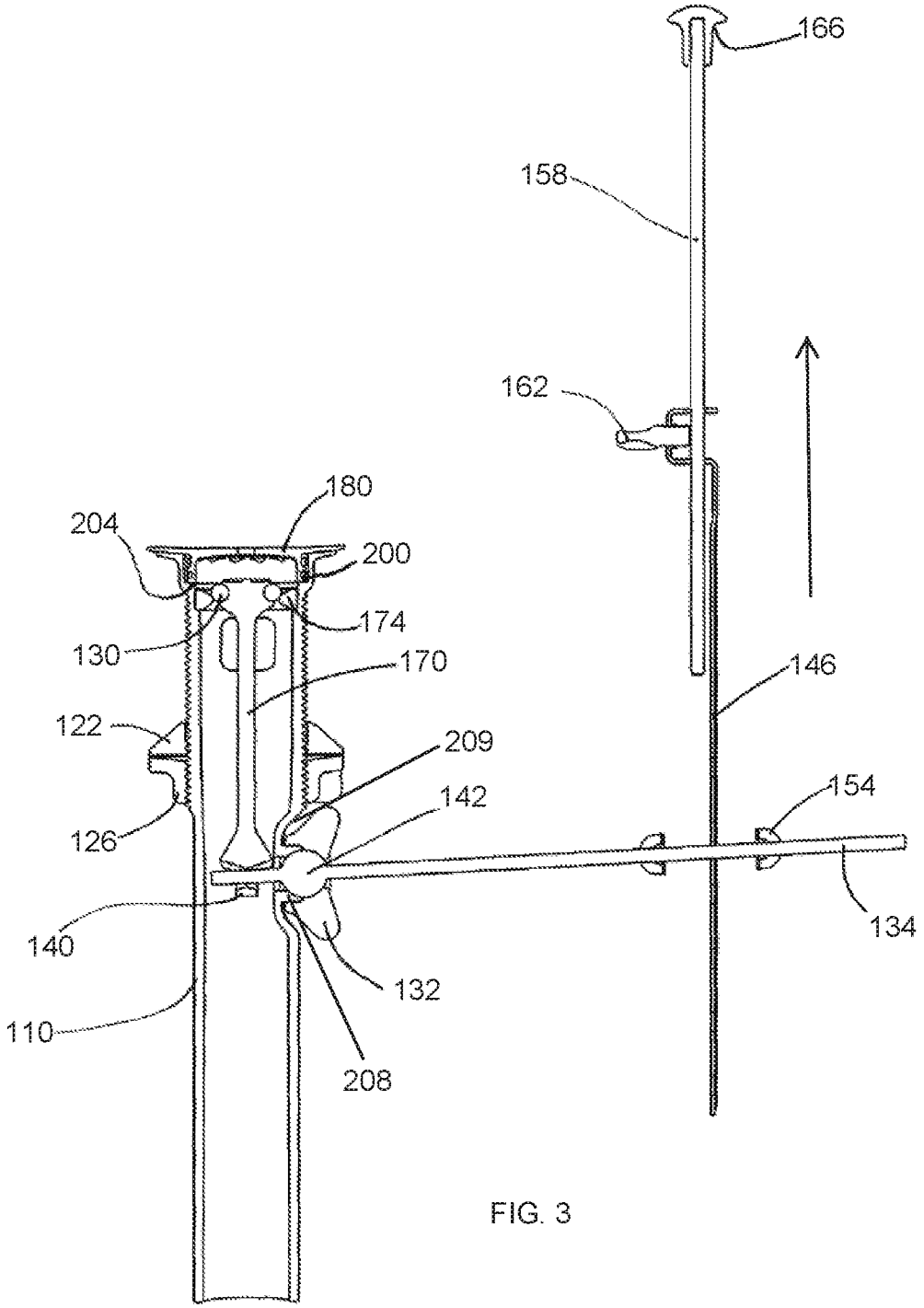
FIG. 3 is a cross-sectional view of FIG. 2 showing a stopper closed.
Figure 4:
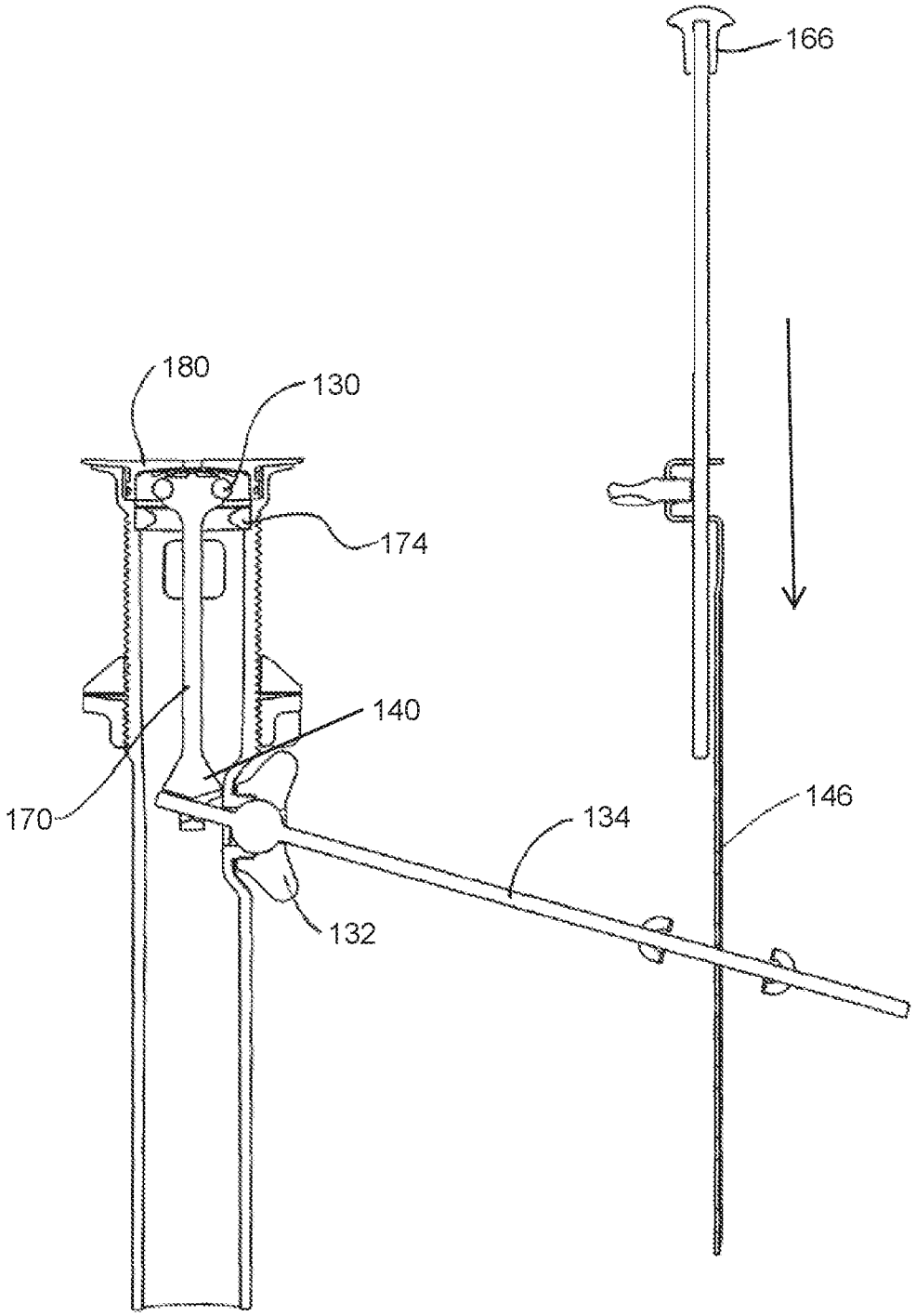
FIG. 4 is a cross-sectional view of FIG. 2 showing the stopper open.

The end of the ball rod 134 positioned in the body is interconnected to a distal end 140 of a valve stem 170. The distal end 140 of some embodiments is flared, or otherwise configured, to prevent hair and other debris from getting hung up on the ball rod 134 (see FIG. 4). The valve stem 170 also includes a proximal end comprised of a drain stopper 130. As shown in FIGS. 3 and 4, the drain stopper 130 cooperates with a seat 174 located within the body 110 to selectively allow fluid out of the sink.

The drain stopper 130, seat 174, etc. are concealed by an insert 180. The insert 180 includes an upper surface 184 with a plurality of holes 188 that allow water, but not large items from entering the drain plumbing. The insert has a wall 194 that accommodates a seal 192 that cooperates with an inner surface 196 of the body to secure the insert 180 the body 110. The wall 194 has a lower surface 200 that engages a shoulder 204 of the body 110 or the flange 114. Because the seal 192 does not permanently secure the insert 180 the body 110, if the insert becomes damaged, stained, or marred, or if the user wishes to change the aesthetic appearance of the sink, the insert 180 can be quickly removed and replaced without replacing the remainder of the wastewater system.

Figure 5:
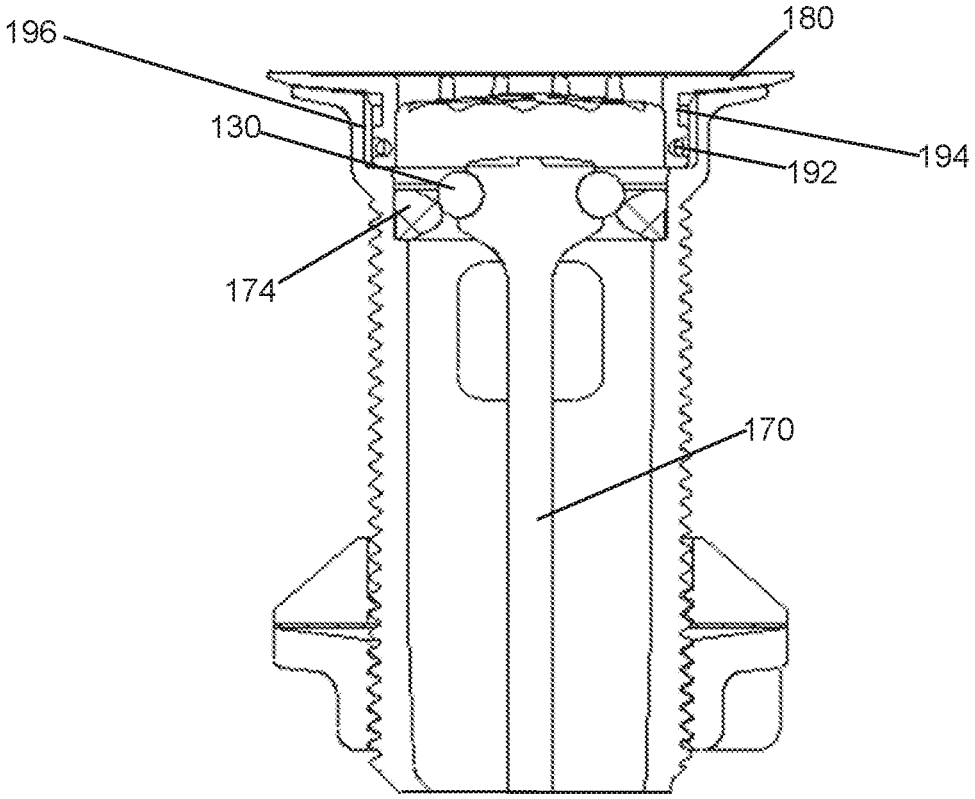
FIG. 5 is a detailed cross-sectional view showing the upper end of the embodiment shown in FIG. 2.

Again, the insert 180 of this embodiment of the present invention will selectively interconnects to a drain flange and associated drain plumbing by way of a seal 192 that selectively engages the inner surface 196 of the drain flange wall 206, i.e., an interference fit (see FIG. 5). The seal 192 may fit within a groove integrated into the insert wall, or within outwardly extending protrusions on the insert wall. Also, multiple seals can be employed, and an enlarged seal may be employed. Those of ordinary skill in the art should appreciate that other interconnection methods or schemes are contemplated. For example, the interconnection methods described in U.S. Pat. Nos. 6,154,898, 7,503,083, 8,607,376, 9,015,870, 9,015,876, and insert interconnection methods similar thereto, may be used to selectively interconnect the insert 180 to the drain flange 114 without departing from the scope of the present invention. Furthermore, some embodiments the present invention: 1) do not employ a seal, and rely on adhesives to secure the flange to the drain flange; 2) do not employ an insert wall, wherein a circular plate is adhered or otherwise interconnected to the drain flange; 3) employ a flange with a downwardly-extending lip for selective engagement onto an outer edge of the drain flange; 4) employ a cylindrical insert wall that selectively engages seals or other interconnection device is associated with the sink strainer or drain plumbing; or 5) employ mating devices that selectively engage with corresponding mating features on the train strainer, i.e., a bayonet fitting or snap in connection.

Figure 2:
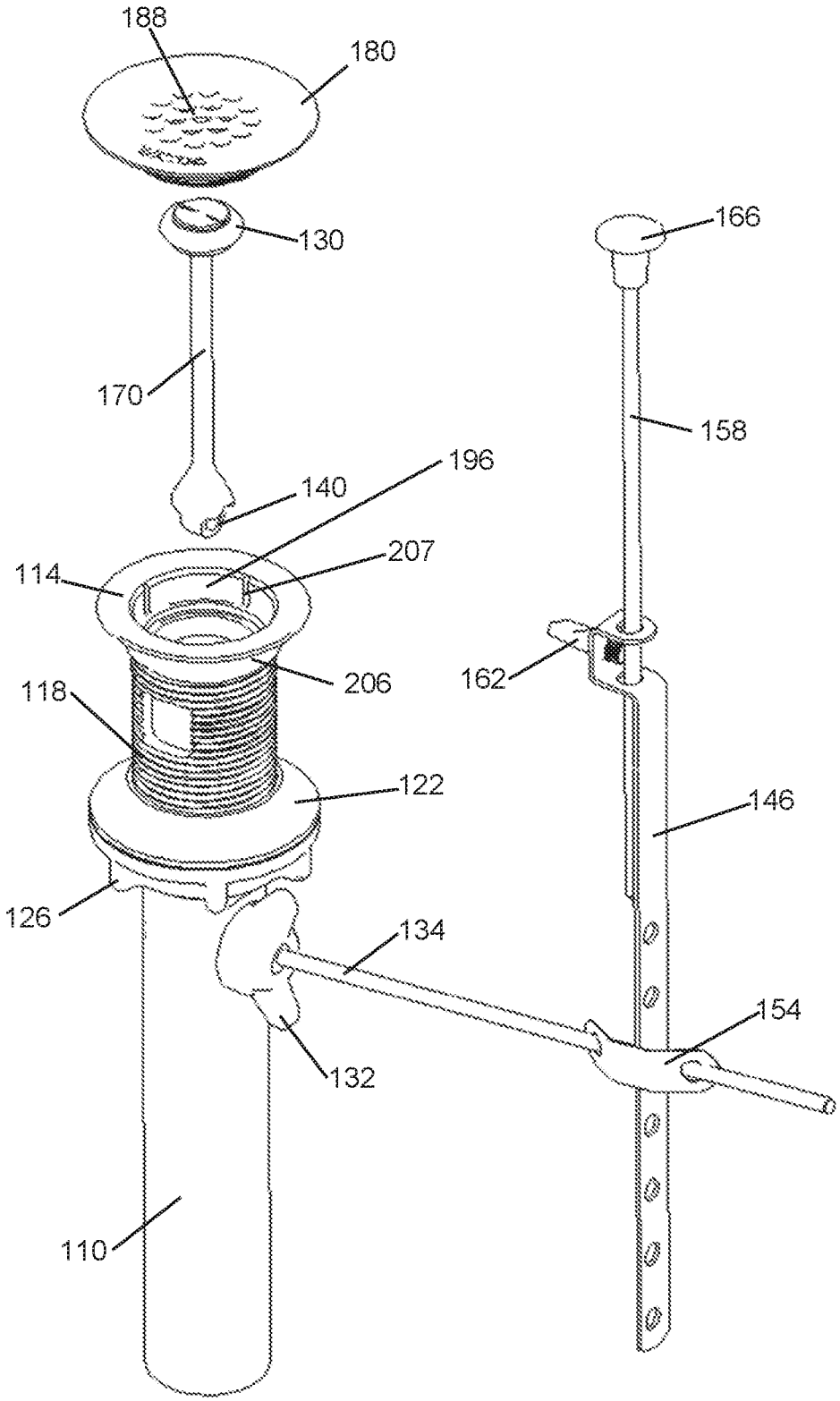
FIG. 2 is a perspective view of a drain closure system of one embodiment of the present invention.

FIG. 2 shows another feature of some embodiments of the present invention. As shown, the flange 114 is interconnected to the threaded portion 118 of the body by way of a cylindrical, semi-cylindrical, or conical wall 206 having the inner surface 196 described above. At least one groove 207 is provided in the wall 206. Water, which does not exit the sink via the openings 188 in the insert 180, can exit the sink through any gap between the insert flange 180 and the sink drain flange 114 and into the drain plumbing via the groove (s) 207.

As discussed above, FIGS. 3 and 5 show the wastewater drain with the drain stopper 130 in a closed position. Here the drain stopper 130 is abutted against the seat 174 which prevents fluid from entering the body 110. This configuration is achieved by pulling the knob 166 upwardly to move the attached rod 158 and link 146 upwardly. Movement of the rod 158 upwardly rotates the end of the ball rod 134 positioned within the body 110 about a ball 142 downwardly, which pulls a distal end 140 of the valve stem 170 downwardly.

FIG. 3 shows another feature provided by some embodiments of the present invention that facilitates installation. Here, a boss 208 that receives the nut 132 is positioned within a recess 209 that locates an outer surface of the boss 208 at a dimension equal to or less than the outer dimension of the body 110. This embodiment facilitates installation by allowing the body 110 to be dropped into the sink outlet. The nut 132 may have outer protrusions, i.e., wings, that facilitate tightening. In contrast, the prior art system shown in FIG. 1 has a larger boss, which does not fit through the drain outlet. To install the prior art system a plumber must position an upper edge of the body through the drain outlet and fasten the sink flange thereto. Then, the nut 22 is used to secure the body 10 to the sink 2. As those of ordinary skill in the art will appreciate, this is a two-hand or two-person operation.

FIG. 4 shows the wastewater drain system in an open position wherein the rod 158 has been pushed downwardly to rotate the end of the ball rod 134 upwardly to push the valve stem 170 upwardly, thereby moving the attached valve stem 170 away from the seat 174 to open the fluid flow path from the sink to the body 110.

Figure 6:
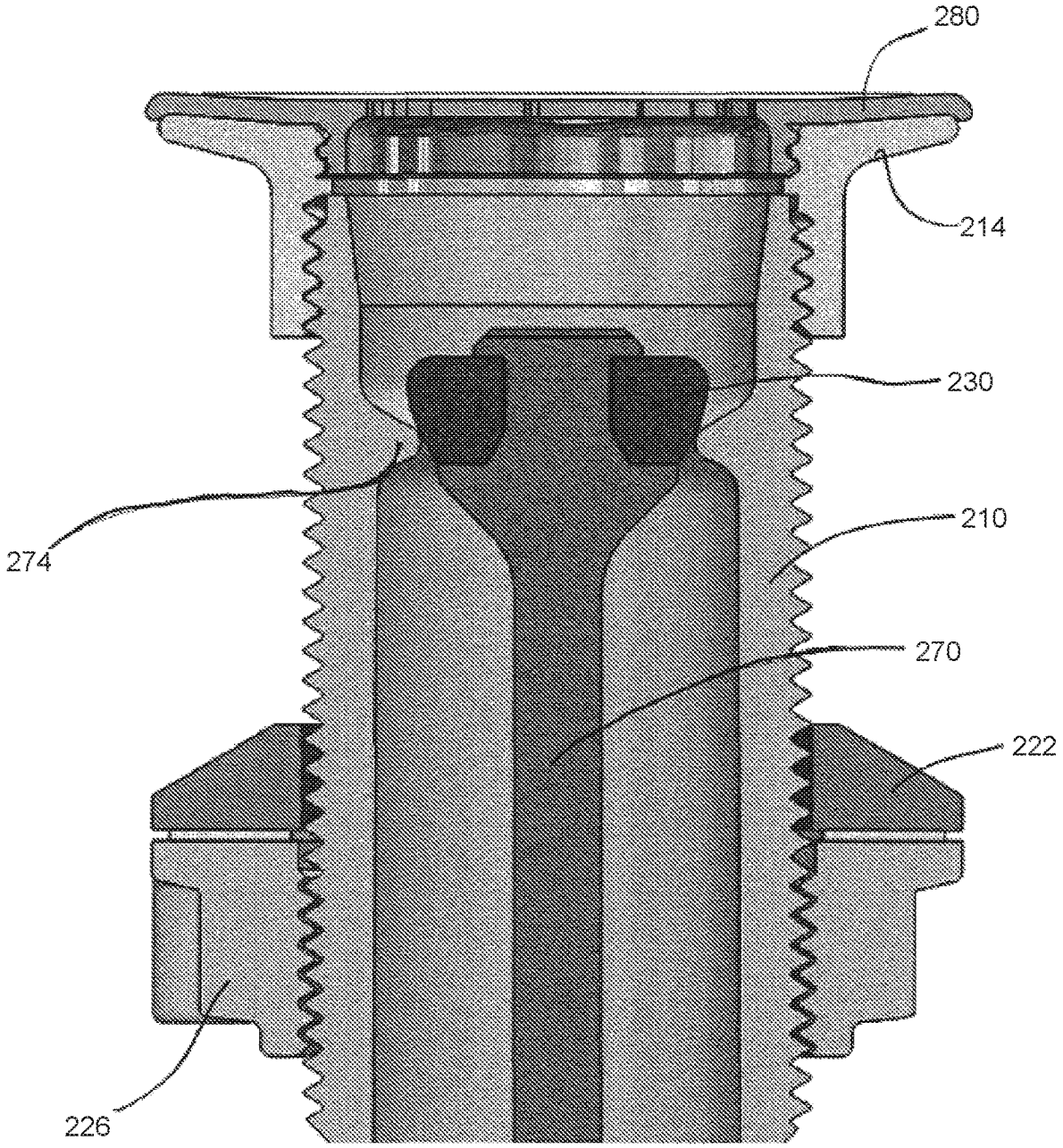
FIG. 6 is a cross-sectional view of another embodiment of the present invention that employs an insert having external threads.
Figure 7:
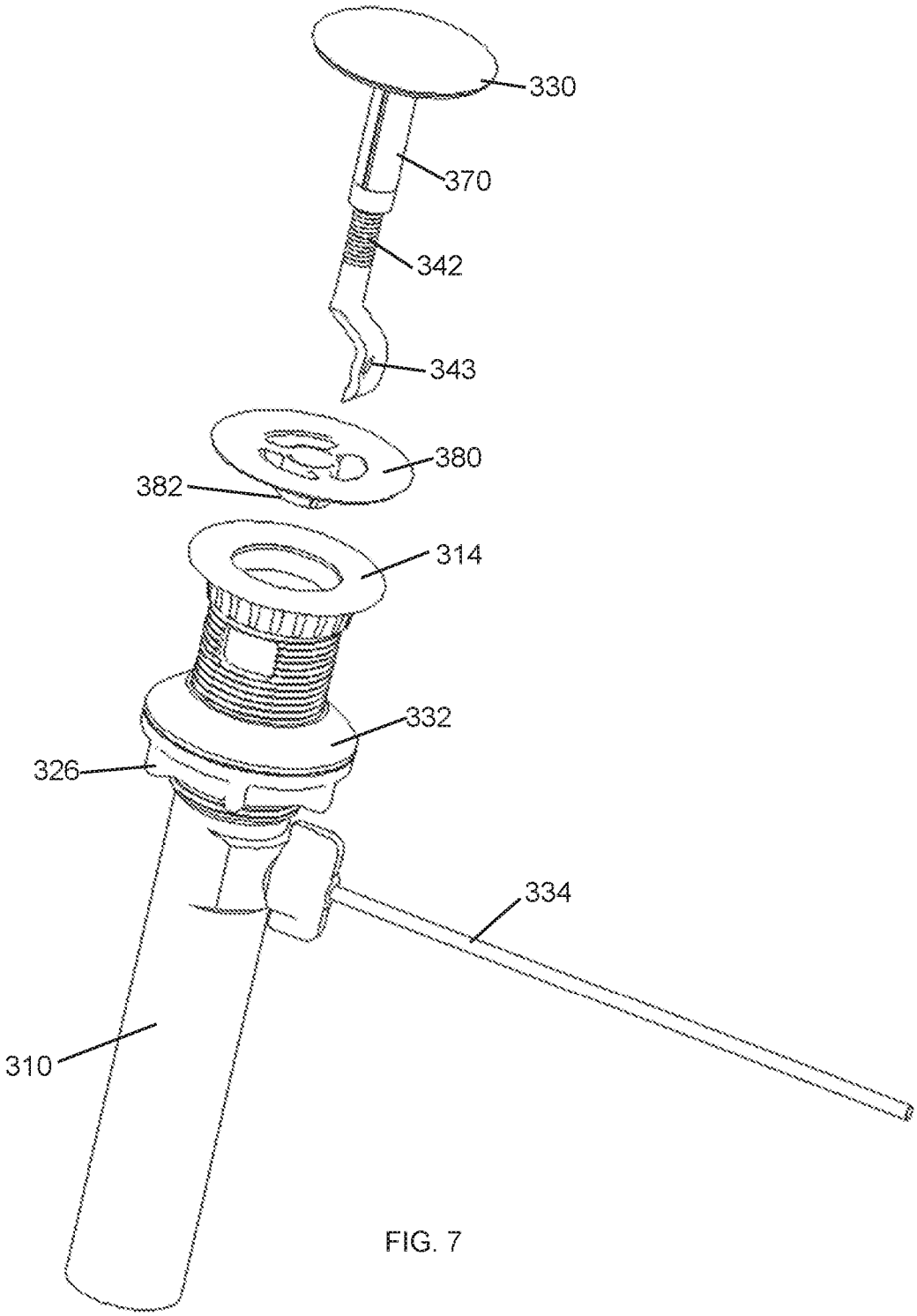
FIG. 7 is an exploded perspective view of another embodiment of the present invention that employs an external stopper.

FIG. 6 shows another embodiment of the present invention where the insert 280 is selectively interconnected to a sink flange 214. Other features of this embodiment are similar to those employed by the embodiments described above. FIG. 6 also shows that sink the flange 214 does not need to be integral to the body to 10, but may be threateningly engaged thereto. The remaining operation of this embodiment of the present invention is similar to or same as that described above, wherein a drain stopper 230, a valve stem 270, a seat 274, a seal 222, and a nut 226 are provided.

FIGS. 7-10 show another embodiment of the present invention wherein the drain stopper 330 is external to the body 310. Here, the drain stopper 330 comprises a downwardly-extending stem 370 and a threaded lower portion 342. The threaded portion 342 is operatively interconnected into the stem 370, thereby allowing the length between the stopper 330 and a distal end 340 to be altered if needed. The threaded portion 342 also includes an opening 343 for receipt of an end of the ball rod 334 positioned within the body 310. Here, the sink flange 314 is selectively interconnected to or integrated with the body 310.

Figure 8:
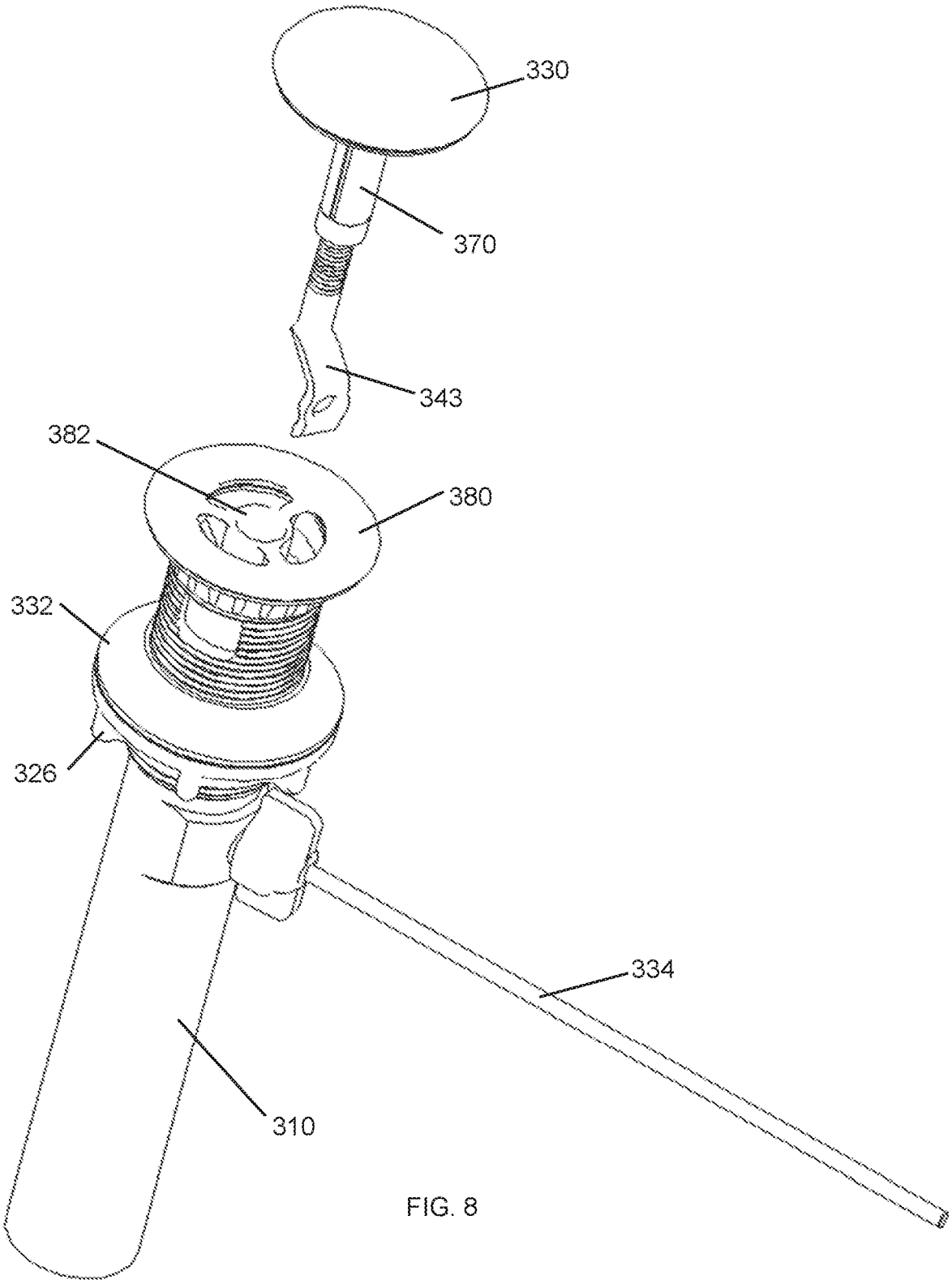
FIG. 8 is a top perspective view of the embodiment shown in FIG. 7.
Figure 9:
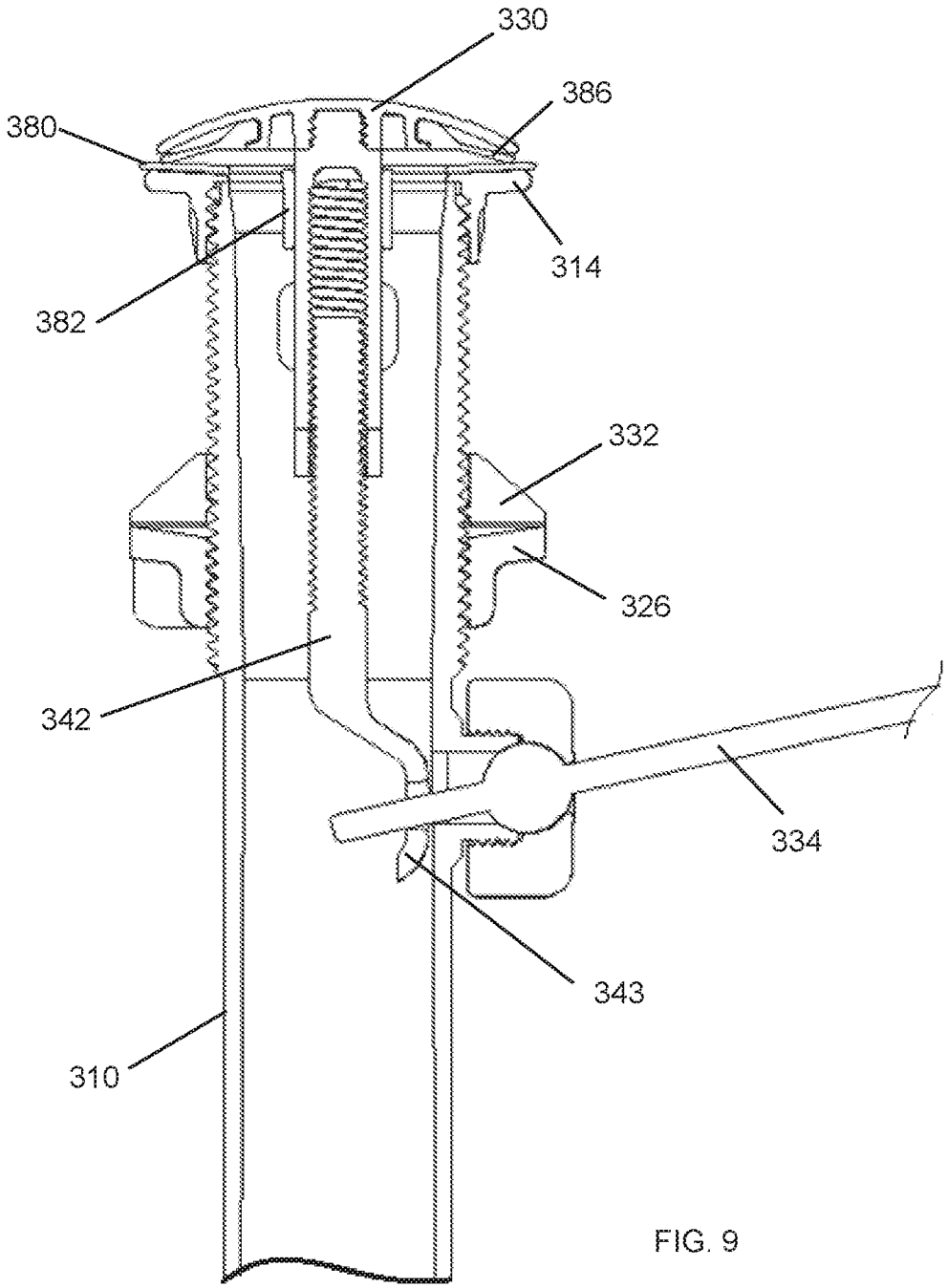
FIG. 9 is a cross-sectional view of FIG. 7.
Figure 10:
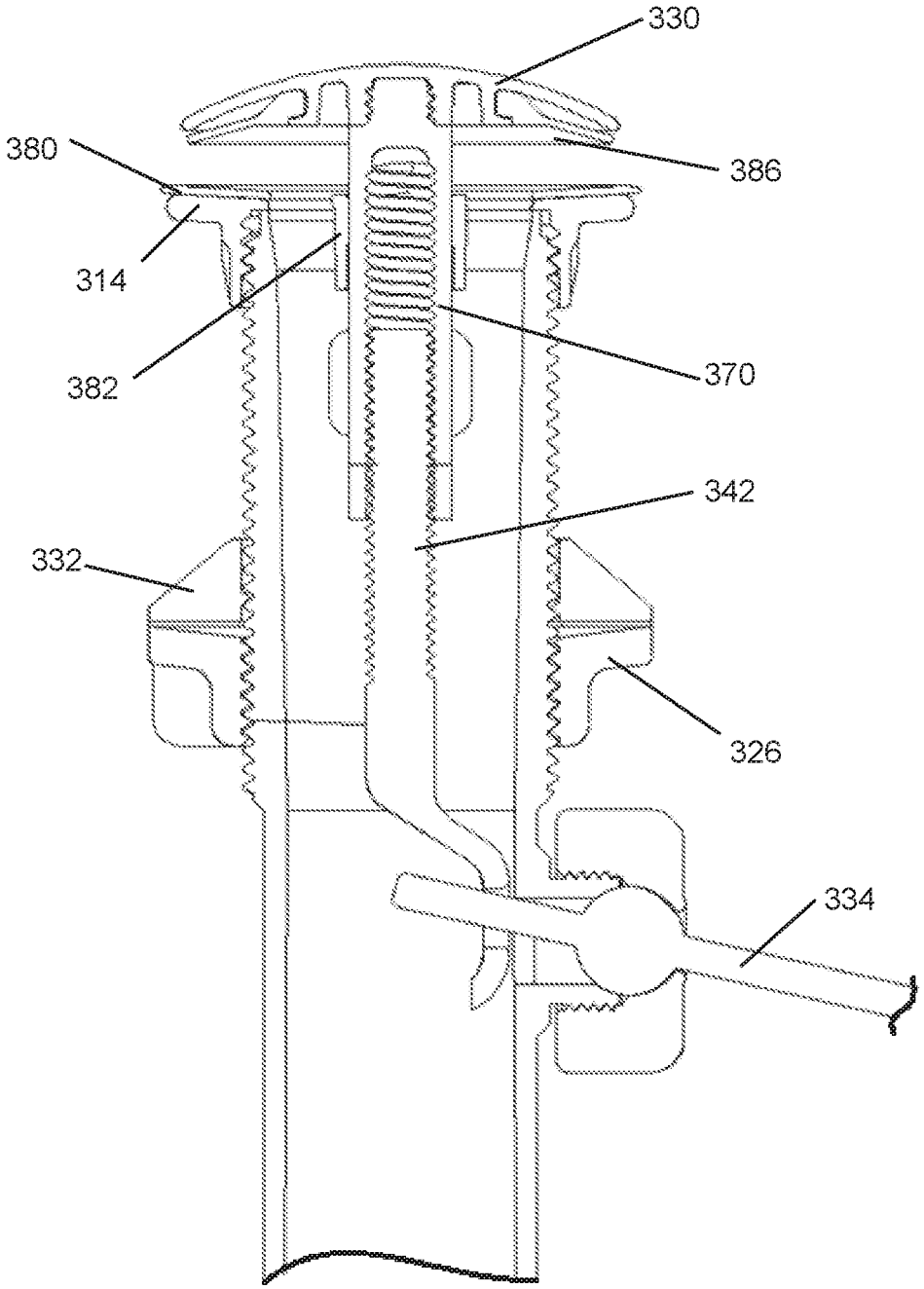
FIG. 10 is a cross-sectional view of FIG. 7, wherein the stopper is opened.

This embodiment also includes an insert 380 with a hub 382 that is attached, e.g., glued, to the flange 314. The insert 380 may also include a wall that selectively interconnects to the sink flange or body as is shown in the embodiments discussed above. The hub 382 provides a cylindrical opening for receipt and securement of the stem 370 as shown in FIGS. 8 and 9. Upon pulling a knob upwardly, (see FIG. 2, for example,) the stem 370 and threaded portion 342 are pulled downwardly, which pulls the stopper 330 and attached seal 386 into engagement with the insert 380 to close the body 310 to the flow. The knob is pushed downwardly, the end of the ball rod 334 moves upwardly, which moves the stem 370 upwardly to separate the seal 386 from the insert 380 allow fluid to flow into the body.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A wastewater drain system comprising:

a ball rod;

a body comprising a first end, an opposite second end, and an opening positioned between the first end and the second end, wherein at least a portion of the ball rod is receivable through the opening;

an insert configured to cover a sink flange, the insert positioned at the first end of the body; and a stem slidingly disposed at least partially within a hub of the insert and comprising a proximal end and a distal end, wherein the proximal end comprises a stopper and the distal end is coupled to the portion of the ball rod received within the body, wherein the ball rod is configured to actuate the stem, and wherein actuating the stem causes the stopper to engage or disengage the insert.

2. The system of claim 1, further comprising a threaded lower portion threadingly coupled to the distal end of the stem, wherein the threaded lower portion is coupled to the portion of the ball rod received within the body and extends between the stem and the ball rod.

3. The system of claim 2, wherein a length between the stopper and the ball rod is adjustable via the threaded lower portion.

4. The system of claim 1, further comprising a seal attached to the stopper such that the seal is positioned between the stopper and the insert.

5. The system of claim 1, further comprising the sink flange positioned at the first end of the body, wherein the first end of the body is threaded and the sink flange is threadingly coupled to the first end.

6. The system of claim 1, further comprising the sink flange positioned at the first end of the body, wherein the sink flange is integrated with the first end of the body.

7. The system of claim 1, further comprising the sink flange positioned at the first end of the body, wherein the insert further comprises an insert flange, and wherein the insert flange is glued to the sink flange.

8. The system of claim 1, further comprising the sink flange positioned at the first end of the body, wherein the insert further comprises an insert flange and an annular insert wall, and wherein the insert wall selectively couples to the sink flange, the first end of the body, or a combination thereof.

9. The system of claim 8, wherein the insert wall threadingly couples to the sink flange.

10. The system of claim 8, wherein the insert wall couples to an inner surface of the first end of the body with a seal member.

11. The system of claim 10, wherein the seal member is an O- ring.

12. The system of claim 1, wherein the hub defines a substantially cylindrical opening for receipt of the stem.

13. A wastewater drain system comprising:

a ball rod;

a body comprising a first end, an opposite second end, and an opening positioned between the first end and the second end, wherein at least a portion of the ball rod is receivable through the opening;

an insert for a sink flange, the insert positioned at the first end of the body; and a stem slidingly disposed at least partially within a hub of the insert and comprising a proximal end and a distal end, wherein the proximal end comprises a stopper and the distal end is coupled to the portion of the ball rod received within the body, wherein the ball rod is configured to actuate the stem, and wherein actuating the stem causes the stopper to engage or disengage the insert.

14. The system of claim 13, further comprising a threaded lower portion threadingly coupled to the distal end of the stem, wherein the treaded lower portion comprises an opening configured to receive at least a portion of the ball rod.

15. The system of claim 14, wherein the threaded lower portion adjusts a length between the stopper and the ball rod.

16. The system of claim 13, further comprising a seal attached to the stopper.

17. The system of claim 16, wherein the ball rod is configured to actuate the stem between a first position that engages the seal against the insert preventing fluid flow through the insert and the body, and a second position that separates the seal from the insert allowing fluid flow through the insert and the body.

18. The system of claim 13, wherein the stopper is threadingly coupled to the proximal end of the stem.

19. The system of claim 13, wherein the insert further comprises a strainer element.

20. The system of claim 13, further comprising the sink flange positioned at the first end of the body, wherein the insert is selectively coupled to the sink flange, the first end of the body, or a combination thereof.

* * * * *